US009789690B2

(12) United States Patent
Watanabe et al.

(10) Patent No.: US 9,789,690 B2
(45) Date of Patent: Oct. 17, 2017

(54) METHOD FOR MANUFACTURING LIQUID EJECTION HEAD

(71) Applicant: CANON KABUSHIKI KAISHA, Tokyo (JP)

(72) Inventors: Masahisa Watanabe, Yokohama (JP); Jun Yamamuro, Yokohama (JP); Kazuhiro Asai, Kawasaki (JP); Keiji Matsumoto, Fukushima (JP); Koji Sasaki, Nagareyama (JP); Kunihito Uohashi, Yokohama (JP); Ryotaro Murakami, Yokohama (JP); Tomohiko Nakano, Kawasaki (JP); Keiji Edamatsu, Kawasaki (JP); Haruka Nakada, Kawasaki (JP); Kenji Fujii, Yokohama (JP); Seiichiro Yaginuma, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/163,961

(22) Filed: May 25, 2016

(65) Prior Publication Data

US 2016/0347065 A1 Dec. 1, 2016

(30) Foreign Application Priority Data

Jun. 1, 2015 (JP) ..... 2015-111369

(51) Int. Cl.
*B41J 2/16* (2006.01)
*B41J 2/14* (2006.01)

(52) U.S. Cl.
CPC ..... *B41J 2/1628* (2013.01); *B41J 2/1404* (2013.01); *B41J 2/1603* (2013.01); *B41J 2/1631* (2013.01)

(58) Field of Classification Search
None
See application file for complete search history.

(56) References Cited

U.S. PATENT DOCUMENTS

| | | | | |
|---|---|---|---|---|
| 7,550,252 | B2 * | 6/2009 | Shimimura | B41J 2/1603 430/320 |
| 8,956,703 | B2 | 2/2015 | Asai et al. | |
| 9,278,532 | B2 | 3/2016 | Asai et al. | |
| 9,308,721 | B2 | 4/2016 | Uohashi et al. | |

(Continued)

FOREIGN PATENT DOCUMENTS

| | | | |
|---|---|---|---|
| JP | 2002-326363 | A | 11/2002 |
| JP | 2012-212825 | A | 11/2012 |

*Primary Examiner* — Allan Olsen
(74) *Attorney, Agent, or Firm* — Fitzpatrick, Cella, Harper & Scinto

(57) ABSTRACT

A method for manufacturing a liquid ejection head includes the steps of: preparing a substrate including an energy-generating element disposed on a first surface of the substrate and a supply path for liquid; disposing a dry film on the first surface of the substrate in such a manner that the dry film partially enters the supply path; etching the dry film from a side of the dry film facing the first surface of the substrate so that the dry film has an etched surface substantially in parallel with the first surface and covers the supply path; forming a resin layer to be a flow path member on the dry film covering the supply path; and removing the dry film covering the supply path.

15 Claims, 3 Drawing Sheets

(56) References Cited

U.S. PATENT DOCUMENTS

| | | | | |
|---|---|---|---|---|
| 2004/0155943 | A1* | 8/2004 | Kim | B41J 2/1404 347/65 |
| 2006/0014107 | A1* | 1/2006 | Park | B41J 2/1603 430/320 |
| 2008/0043067 | A1* | 2/2008 | Nayve | B41J 2/161 347/68 |
| 2014/0068940 | A1 | 3/2014 | Asai et al. | |
| 2015/0004724 | A1* | 1/2015 | Watanabe | B41J 2/1603 438/21 |
| 2015/0129542 | A1* | 5/2015 | Ohsumi | B41J 2/1639 216/27 |
| 2015/0151544 | A1* | 6/2015 | Asai | B41J 2/14145 156/247 |
| 2015/0197092 | A1* | 7/2015 | Matsumoto | B41J 2/1628 216/36 |
| 2016/0311222 | A1* | 10/2016 | Sasaki | B41J 2/1631 |
| 2016/0347065 | A1* | 12/2016 | Watanabe | B41J 2/1404 |
| 2017/0028730 | A1* | 2/2017 | Yaginuma | B41J 2/175 |

* cited by examiner

METHOD FOR MANUFACTURING LIQUID EJECTION HEAD

BACKGROUND OF THE INVENTION

Field of the Invention

The present invention relates to a method for manufacturing a liquid ejection head.

Description of the Related Art

A liquid ejection head is used as a liquid ejection device of, for example, an ink-jet recording apparatus and is exemplified by a liquid ejection head described in Japanese Patent Application Laid-Open No. 2002-326363, for example. On the other hand, Japanese Patent Application Laid-Open No. 2012-212825 describes a method for filling a through hole with a filler as a method for manufacturing a wiring board on which a tenting process can be performed.

SUMMARY OF THE INVENTION

The present invention is directed to providing a method for manufacturing a liquid ejection head which includes the steps of: preparing a substrate including an energy-generating element disposed on a first surface of the substrate and a supply path for liquid; disposing a dry film on the first surface of the substrate in such a manner that the dry film partially enters the supply path; etching the dry film from a side of the dry film facing the first surface of the substrate so that the dry film has an etched surface substantially in parallel with the first surface and covers the supply path; forming a resin layer to be a flow path member on the dry film covering the supply path; and removing the dry film covering the supply path.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Japanese Patent Application Laid-Open No. 2002-326363 describes a method in which a through hole is filled with a filler by bringing a tape or a glass plate into contact with a substrate surface and then a flow path member is formed. In the case of filling the through hole with the filler using the tape, however, an adhesive of the tape enters a supply path for liquid so that the filling depth varies, resulting in the possibility of occurrence of a accuracy variation in forming the flow path member. In the case of filling the through hole with the filler by bringing the glass plate into contact with the substrate surface, the filler protrudes from a gap so that the accuracy in forming the flow path member might decrease.

On the other hand, in the case of filling the through hole with the filler without contact with the substrate surface, as in the method described in Japanese Patent Application Laid-Open No. 2012-212825, it is difficult to control the filling depth, and unevenness might occur on the surface of the filler filling the through hole. Thus, an accuracy in forming the flow path member on the filler might decrease.

In view of the foregoing problems, an object of the present invention is to provide a liquid ejection head that is manufactured accurately.

In a method for manufacturing a liquid ejection head according to the present invention, a dry film is disposed to partially enter a supply path of a substrate, and then the dry film is etched from a side of the dry film facing a first surface of the substrate. In this manner, the resulting dry film has an etched surface substantially in parallel with the first surface and covers the supply path. Since the etched surface of the dry film covering the supply path is flat, in a subsequent process step in which a mold or a flow path member for forming a liquid flow path on the dry film covering the supply path, the mold or the flow path member can be formed accurately. Thus, a liquid ejection head can be manufactured accurately. The present invention will be described hereinafter in detail.

Figure 1:
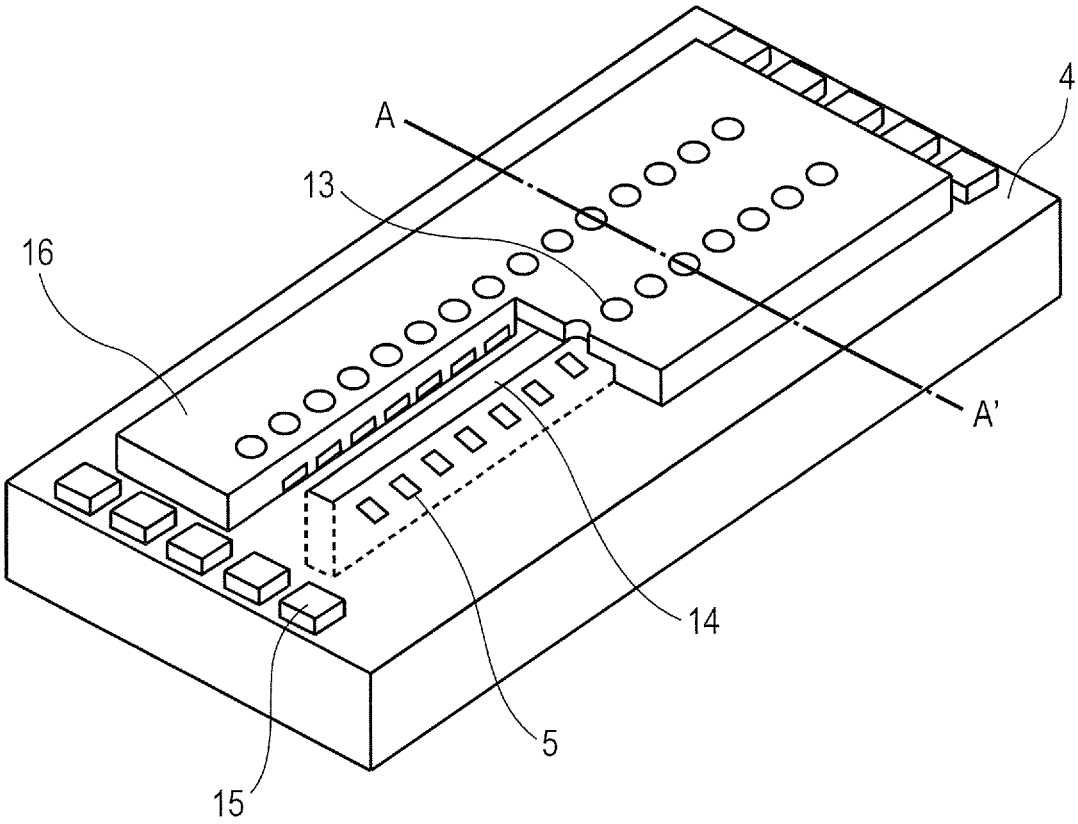
FIG. 1 is a perspective view illustrating an example of a liquid ejection head manufactured by a method according to the present invention.

FIG. 1 illustrates an example of a liquid ejection head manufactured by a method according to the present invention. The liquid ejection head illustrated in FIG. 1 includes a substrate 4 and a flow path member 16. The substrate 4 is made of silicon, for example. Energy-generating elements 5 are disposed on a first surface of the substrate 4. Examples of energy-generating elements 5 include heat resistive members and piezoelectric elements. The energy-generating elements 5 may be in contact with the first surface of the substrate 4 or may partially form a gap between the energy-generating elements 5 and the first surface of the substrate 4. Terminals 15 are formed on the first surface of the substrate 4, and the energy-generating elements 5 are driven by electric power supplied from an external device outside the substrate 4 through the terminals 15. The substrate 4 includes a supply path 14 for liquid passing through the first surface and a second surface at the opposite side of the substrate 4 to the first surface. Liquid supplied from the second surface of the substrate 4 through the supply path 14 receives energy from the energy-generating elements 5 that are driven, and is ejected in the form of liquid droplets from an ejection orifice 13 formed in the flow path member 16. The liquid ejection head is preferably used as an ink jet recording head that can perform recording by ejecting ink onto a recording medium.

An embodiment of a method for manufacturing a liquid ejection head according to the present invention will now be described with reference to FIGS. 2A to 2I. FIGS. 2A to 2I are cross sectional views corresponding to process steps and illustrating a portion of the liquid ejection head taken along line A-A' in FIG. 1. The method according to the present invention is not limited to this embodiment.

Figure 2A:
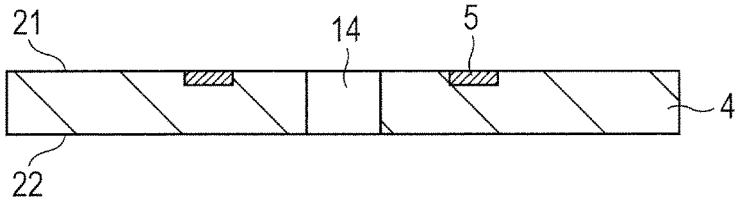
FIGS. 2A, 2B, 2C, 2D, 2E, 2F, 2G, 2H and 2I are cross sectional views corresponding to process steps of an embodiment of a method for manufacturing a liquid ejection head according to the present invention.

First, as illustrated in FIG. 2A, a substrate 4 having a first surface 21 on which energy-generating elements 5 are disposed is prepared. The energy-generating elements 5 may be covered with a protective layer (not shown) of SiN or $SiO_2$, for example. The substrate 4 includes a supply path 14 for liquid passing through the substrate 4. The supply path 14 may be formed by, for example, laser processing, reactive ion etching, sandblasting, and wet etching. The cross-sectional shape of the supply path 14 is not specifically limited, and may be a circle or a rectangle, for example. In a case where the cross-sectional shape of the supply path 14 is a rectangle, a side of the rectangle can be 10 μm to 150 μm. A longer side of the rectangle can be 10 μm to 25000 μm. FIG. 2A illustrates an example in which the supply path 14 is formed by reactive ion etching. In particular, an inner wall of the supply path 14 is preferably substantially perpendicular to the first surface 21 and the second surface 22.

Figure 2B:
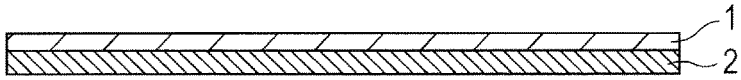

Then, as illustrated in FIG. 2B, a dry film 2 supported by a support member 1 is prepared. Examples of the support member 1 include a film, a glass plate, and a silicon plate. In consideration of a subsequent step of detachment, the support member 1 is preferably a film. Examples of the film include a polyethylene terephthalate (PET) film, a polyimide film, a polyamide film, a polyaramid film, a Teflon (registered trademark) film, and a polyvinyl alcohol film. To ease detachment of the support member 1 from the dry film 2, a release treatment may be performed on the surface of the support member 1.

The dry film 2 may contain a resin. The resin may be a photosensitive resin or a non-photosensitive resin. In a process step described later, to cause a part of the dry film 2 to enter the supply path 14, the resin preferably has a softening point of 40° C. or more and 120° C. or less. The softening point of the resin can be measured with a thermomechanical analysis (TMA) apparatus. The softening point of the resin is preferably higher than a temperature at which a step of forming a resin layer 6 described later is performed, that is, temperatures in all the operations performed in the step of forming the resin layer 6. This is because of the purpose of preventing the dry film 2 covering the supply path 14 from softening in the step of forming the resin layer 6. In addition, from the viewpoint of forming the dry film 2 on the support member 1 in a favorable manner, the resin is preferably a resin soluble in an organic solvent. Examples of such a resin include an epoxy resin, an acrylic resin, a urethane resin, and a polyether amide resin. Examples of the epoxy resin include a bisphenol A epoxy resin, a cresol novolac epoxy resin, and an alicyclic epoxy resin. Examples of the acrylic resin include polymethyl methacrylate. Examples of the urethane resin include polyurethane. These materials may be used alone or two or more of these materials may be used in combination. Examples of a solvent in which the resins described above are dissolved include propylene glycol methyl ether acetate (PGMEA), cyclohexanone, methyl ethyl ketone, and xylene. These materials may be used alone or two or more of these materials may be used in combination. The dry film 2 can be formed by applying a solution in which the resin as mentioned above is dissolved in the solvent as mentioned above, for example, onto the support member 1 by a process such as spin coating or slit coating and drying the applied solution at 50° C. or more. The solution in which the resin is dissolved in the solvent preferably has a viscosity of 5 cP or more and 150 cP or less. The dry film 2 on the support member 1 preferably has a thickness of 5 μm or more and 30 μm or less.

Figure 2C:
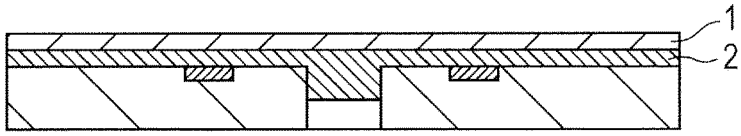

Thereafter, as illustrated in FIG. 2C, the dry film 2 supported by the support member 1 is disposed on the first surface 21 of the substrate 4 including the supply path 14 in such a manner that a part of the dry film 2 enters the supply path 14. The entry of the part of the dry film 2 into the supply path 14 causes at least a part of the supply path 14 to be covered with the dry film 2. The length of the dry film 2 that has entered the supply path 14, that is, the depth of entry of the dry film 2, from the first surface 21 of the substrate 4 can be controlled by adjusting conditions such as a temperature and a pressure in disposing the dry film 2. This length is preferably 5 μm or more and 100 μm or less, and more preferably 6 μm or more and 50 μm or less. From the viewpoint of strength for supporting the dry film 2 and the time necessary for removing the dry film 2 in an etching process of the dry film 2 described later, the length is much more preferably 7 μm or more and 30 μm or less. The temperature in disposing the dry film 2 is preferably greater than or equal to the softening point of the resin contained in the dry film 2. The dry film 2 is preferably disposed by applying a pressure onto the top of the support member 1 with, for example, a roll laminator. The pressure is preferably 0.01 MPa or more and 1.00 MPa or less, and more preferably 0.10 MPa or more and 0.50 MPa or less. The dry film 2 may not be supported by the support member 1 and may be placed on the first surface 21 of the substrate 4 without a support. In a case where the dry film 2 contains a photosensitive resin, a step of disposing the dry film 2 on the first surface 21 of the substrate 4 and then exposing the dry film 2 to light so that the dry film 2 is cured can be performed.

Figure 2D:
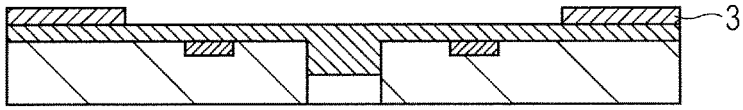

Subsequently, as illustrated in FIG. 2D, the support member 1 is detached from the dry film 2 and the dry film 2 is transferred onto the substrate 4. Thereafter, an etching mask 3 is formed on the dry film 2. The etching mask 3 can be formed by, for example, so-called photolithography in which a solution containing, for example, a photosensitive resin is applied by spin coating or slit coating, dried, subjected to pattern exposure, and then developed. The etching mask 3 can also be formed by using a dry film.

Figure 2E:
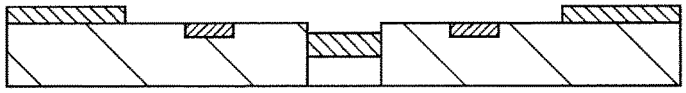

Then, as illustrated in FIG. 2E, the dry film 2 is etched from a side of the dry film 2 facing the first surface 21 of the substrate 4 so that the resulting dry film 2 has an etched surface substantially in parallel with the first surface 21 and covers the supply path 14. Specifically, the dry film 2 is etched using the etching mask 3 to be partially removed in such a manner that the supply path 14 is not open. The removal of the dry film 2 by etching eases control of an absolute value of the distance between the first surface 21 of the substrate 4 and the dry film 2 that has entered the supply path 14 and a distribution in the substrate surface. Thus, the dimensional accuracy in forming the mold 7 and the flow path member 16 on the substrate 4 can be enhanced in a subsequent process step. This is because of enhancement of a thickness distribution in forming the mold 7 and the flow path member 16 by applying a material and disposing the dry film. Dimensions of the mold 7 and the flow path member 16 might change because light irradiated when the mold 7 and the flow path member 16 are formed by photolithography is reflected on the dry film 2 that has entered the supply path 14. This dimensional change is uniformized in the substrate surface so that accuracy of dimensions of the mold 7 and the flow path member 16 can be enhanced. The term "substantially in parallel" herein refers to a parallel position within the range of ±5°.

The etching of the dry film 2 is preferably dry etching because dry etching enables easy control of the etching depth and accurate planarization of the etched surface. Examples of the dry etching include reactive ion etching and reactive gas etching. The dry etching is preferably anisotropic etching from the viewpoint of planarization of the etched surface. As illustrated in FIG. 2E, the dry film 2 is preferably etched until the etched surface of the dry film 2 that has entered the supply path 14 is located below the first surface 21 of the substrate 4. This is because this etching can reduce the influence of etching damage or notching on the substrate 4 in a subsequent process step of removing the dry film 2. The distance between the dry film 2 (the etched surface of the dry film 2) covering the supply path 14 and the first surface 21 of the substrate 4 is preferably 1 μm or more and 30 μm or less. From the viewpoint of easiness in forming and removing the mold 7 on the first surface 21 of the substrate 4, the distance is more preferably 2 μm or more and 10 μm or less. Thereafter, the etching mask 3 is removed. The dry film 2 remaining on the first surface 21 of the substrate 4 is used as a part of the flow path member 16. In this manner, adhesion between the first surface 21 and the flow path member 16 can be enhanced.

Figure 2F:
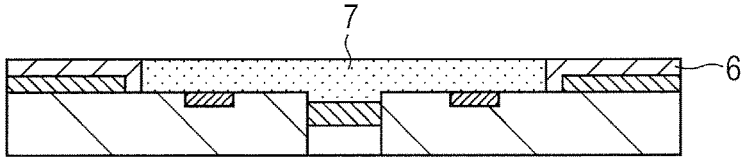

Then, as illustrated in FIG. 2F, a first resin layer 6 to be a part of the flow path member 16 is formed on the dry film 2 covering the supply path 14. The first resin layer 6 is preferably made of a photosensitive resin from the viewpoint of easy formation of the mold 7 by pattern exposure. Examples of the photosensitive resin include an epoxy resin, an acrylic resin, and a urethane resin. Examples of the epoxy resin include a bisphenol A epoxy resin, a cresol novolac epoxy resin, and an alicyclic epoxy resin. Examples of the acrylic resin include polymethyl methacrylate. Examples of the urethane resin include polyurethane. These materials may be used alone or two or more of these materials may be used in combination. The first resin layer 6 can be formed by, for example, applying a solution in which a material constituting the first resin layer 6 containing, for example, the photosensitive resin and a photoacid generator is dissolved in a solvent, and drying the solution. Examples of the solvent include propylene glycol methyl ether acetate (PGMEA), cyclohexanone, methyl ethyl ketone, and xylene. These materials may be used alone or two or more of these materials may be used in combination. The solvent is preferably a solvent in which a solubility of the resin contained in the dry film 2 is lower than a solubility of the material constituting the first resin layer 6 in the solvent, from the viewpoint of formation of the first resin layer 6 without dissolution of the dry film 2. The solubility can be calculated from solubility parameters (SP values) described in documents. The first resin layer 6 can be formed by applying a solution in which the photosensitive resin is dissolved in a solvent onto the support member, drying the solution, and then performing a transfer. The thickness of the first resin layer 6 is not specifically limited, and may be 5 to 30 μm, for example. Then, the first resin layer 6 is subjected to pattern exposure, thereby forming a mold 7. At this time, the mold 7 preferably partially enters the supply path 14 from the viewpoint of suppression of entry of an etching gas. In the case of using a photosensitive resin as a material for the dry film 2, the photosensitive resin used as a material for the first resin layer 6 can have a difference in sensitivity to the photosensitive resin used as the material for the dry film 2.

Figure 2G:
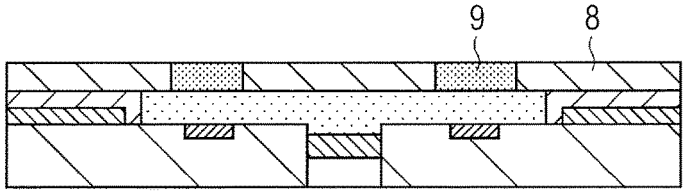

Thereafter, as illustrated in FIG. 2G, a second resin layer 8 to be a part of the flow path member 16 is formed. A material for the second resin layer 8 can be a material similar to that for the first resin layer 6. The second resin layer 8 can be formed in a manner similar to that of the first resin layer 6. In the case of using a photosensitive resin as a material for the first resin layer 6, the photosensitive resin used as a material for the second resin layer 8 preferably has a difference in sensitivity from the photosensitive resin used as a material for the first resin layer 6. The thickness of the second resin layer 8 is not specifically limited, and may be 1 μm or more and 20 μm or less, for example. The second resin layer 8 is then subjected to pattern exposure, thereby forming a pattern 9 of an ejection orifice.

Figure 2H:
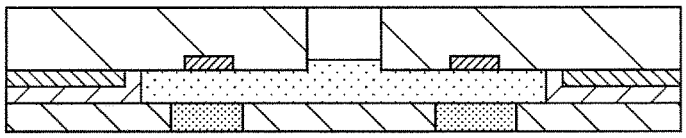

Subsequently, as illustrated in FIG. 2H, the dry film 2 covering the supply path 14 is removed. The removal of the dry film 2 covering the supply path 14 can be performed by, for example, etching from a side of the dry film 2 facing the second surface 22 of the substrate 4. From the viewpoint of removal, the etching is preferably dry etching, and is more preferably reactive ion etching.

Figure 2I:
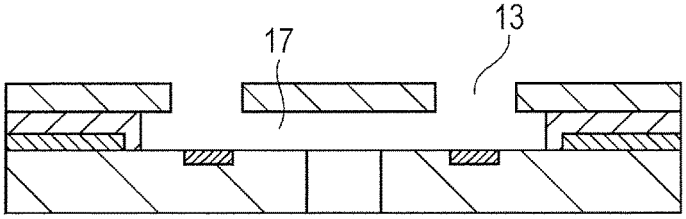

Then, as illustrated in FIG. 2I, the mold 7 and the pattern 9 of an ejection orifice are removed. The removal of the mold 7 and the pattern 9 of an ejection orifice can be performed by immersing the mold 7 and the pattern 9 in a solvent such as PGMEA and developing the mold 7 and the pattern 9. In this manner, a flow path 17 and an ejection orifice 13 are formed. Subsequently, electrical connection, for example, is performed, thereby forming a liquid ejection head.

Figure 3A:
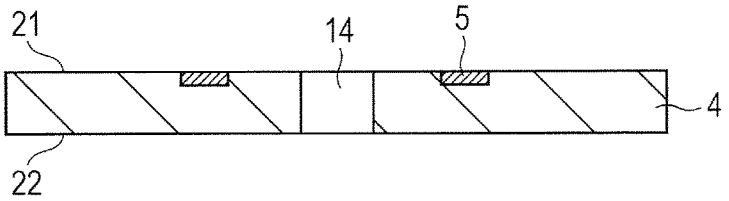
FIGS. 3A, 3B, 3C, 3D, 3E, 3F, 3G, 3H and 3I are cross sectional views corresponding to process steps of another embodiment of the method for manufacturing a liquid ejection head according to the present invention.
Figure 3B:
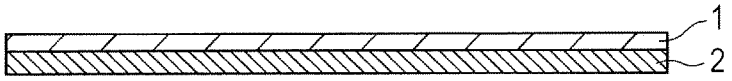
Figure 3C:
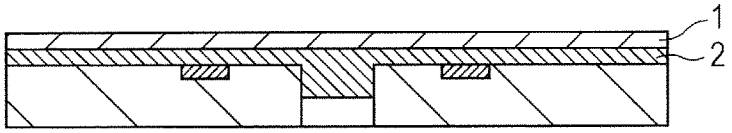
Figure 3D:
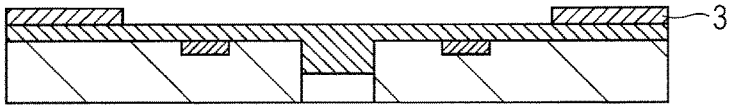
Figure 3E:
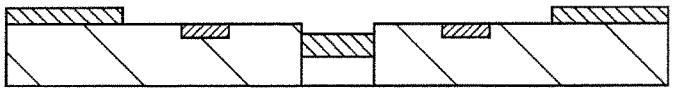
Figure 3F:
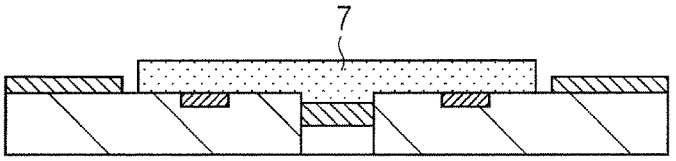
Figure 3G:
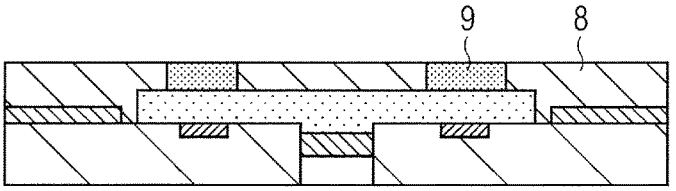
Figure 3H:
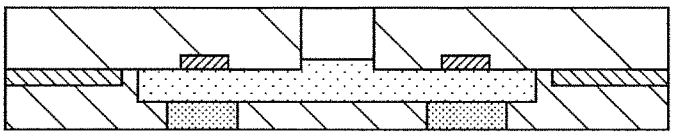
Figure 3I:
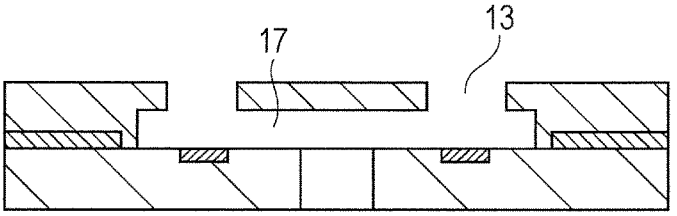

Another embodiment of a method for manufacturing a liquid ejection head according to the present invention will be described with reference to FIGS. 3A to 3I. FIGS. 3A to 3I are cross sectional views corresponding to process steps and illustrating a portion of the liquid ejection head taken along line A-A' in FIG. 1. Process steps illustrated in FIGS. 3A to 3E, 3H, and 3I are similar to FIGS. 2A to 2E, 2H, and 2I, and description thereof will not be repeated. In this embodiment, as illustrated in FIGS. 3F and 3G, a mold 7 is formed, and then a resin layer 8 to be a flow path member 16 is formed. Thereafter, a pattern 9 of an ejection orifice is formed by exposure to light. In this manner, the mold 7 may be formed independently with the resin layer 8 being formed as a single layer. The methods for forming the mold 7, the resin layer 8, and the pattern 9 of an ejection orifice may be similar to those of the embodiment illustrated in FIGS. 2A to 2I.

EXAMPLES

Examples of the present invention will now be described in detail, but the present invention is not limited to these examples.

Example 1

A liquid ejection head was obtained through process steps illustrated in FIGS. 2A to 2I. First, as illustrated in FIG. 2A, a substrate 4 provided with energy-generating elements 5 of TaSiN on a first surface 21 was prepared. The substrate 4 was a substrate of single crystal of silicon having a crystal orientation of (100) in the first surface 21. A protective layer (not shown) of SiN was formed on the first surface 21 of the substrate 4. The substrate 4 included a supply path 14 for liquid, and the supply path 14 passing through the substrate 4. The supply path 14 was formed by a Bosch process using reactive ion etching (RIE). The cross-sectional shape of the supply path 14 was a square having a size of 100 μm×20000 μm.

Then, as illustrated in FIG. 2B, a dry film 2 supported by a support member 1 was prepared. The support member 1 was made of PET. The dry film 2 was formed by applying a solution in which a polyether amide resin (trade name: HIMAL, produced by Hitachi Chemical Company, Ltd.) was dissolved in a solvent onto the support member 1, and drying the solution at 100° C. with an oven. The thickness of the dry film 2 on the support member 1 was 10 μm.

Thereafter, as illustrated in FIG. 2C, the dry film 2 supported by the support member 1 was disposed on the first surface 21 of the substrate 4. The dry film 2 was disposed by using a roll laminator (trade name: VTM-200, produced by Takatori Corporation) with a temperature of the dry film 2 being set at 90° C. and a pressure application to the substrate 4 being set at 0.4 MPa. Consequently, a part of the dry film 2 entered the supply path 14. The length of the dry film 2 that had entered the supply path 14 from the first surface 21 of the substrate 4 was 20 μm.

Subsequently, as illustrated in FIG. 2D, the support member 1 was detached from the dry film 2 at 25° C., and the dry film 2 was transferred onto the substrate 4. Thereafter, an etching mask 3 was formed by photolithography on the dry film 2. The etching mask 3 was made of THMR-iP5700 HP (trade name, produced by TOKYO OHKA KOGYO CO., LTD.). The thickness of the etching mask 3 was 10 μm.

Then, as illustrated in FIG. 2E, the dry film 2 was etched by reactive ion etching from a side of the dry film 2 facing the first surface 21 of the substrate 4 using the etching mask 3 as a mask. The part of the dry film 2 that had entered the supply path 14 was etched to have an etched surface substantially in parallel with the first surface 21 of the substrate 4, that is, was planarized until the etched surface of the dry film 2 was lower than the first surface 21 of the substrate 4. In this manner, the resulting dry film 2 covered the supply path 14. The distance (the height of a step) of the dry film 2 covering the supply path 14 from the first surface 21 of the substrate 4 was 5 μm. Thereafter, the etching mask 3 was removed.

Subsequently, as illustrated in FIG. 2F, a first resin layer 6 to be a part of the flow path member 16 was formed. First, a solution in which an epoxy resin (trade name: N-695, produced by DIC Corporation) and a photoacid generator (trade name: CPI-2105, produced by San-Apro Ltd.) were dissolved in PGMEA onto the support member and drying the solution, thereby producing a dry film supported by the support member. The dry film was then transferred with a roll laminator, thereby forming a first resin layer 6. The first resin layer 6 had a thickness of 15 μm. Thereafter, the first resin layer 6 was subjected to pattern exposure with light having a wavelength of 365 nm and a light exposure amount of 5000 J/m$^2$ using an exposure device (trade name: FPA-3000i5+, produced by Canon Inc.), thereby forming a mold 7 for forming a liquid flow path in the first resin layer 6. Thereafter, a bake was performed at 50° C. for five minutes.

Then, as illustrated in FIG. 2G, a second resin layer 8 to be a part of the flow path member 16 was formed. First, a solution in which an epoxy resin (trade name: 157S70, produced by Japan Epoxy Resin Co.) and a photoinitiator (trade name: LW-S1, produced by San-Apro Ltd.) were dissolved in PGMEA was applied onto the support member, and the solution was dried, thereby forming a dry film supported by the support member. This dry film was then transferred with a roll laminator, thereby forming a second resin layer 8. The second resin layer 8 had a difference in sensitivity from that of the first resin layer 6. The second resin layer 8 had a thickness of 10 μm. Thereafter, the second resin layer 8 was subjected to pattern exposure with light having a wavelength of 365 nm and a light exposure amount of 1000 J/m$^2$ using an exposure device (trade name: FPA-3000i5+, produced by Canon Inc.), thereby forming a pattern 9 of an ejection orifice. Thereafter, a bake was performed at 90° C. for five minutes.

Then, as illustrated in FIG. 2H, using the mold 7 as a stopper layer, the dry film 2 covering the supply path 14 was removed by reactive ion etching from a side of the dry film 2 facing the second surface 22 of the substrate 4.

Subsequently, as illustrated in FIG. 2I, the substrate 4 was immersed in PGMEA so that the mold 7 and the pattern 9 of an ejection orifice were developed, thereby forming a flow path 17 and an ejection orifice 13.

Lastly, electrical connection, for example, was performed, and a liquid ejection head was manufactured. From observation of the liquid ejection head with an electron microscope, it was confirmed that the liquid ejection head was produced with high accuracy.

Example 2

A liquid ejection head was manufactured through process steps illustrated in FIGS. 3A to 3I. Process steps illustrated in FIGS. 3A to 3E, 3H, and 3I are similar to the process steps illustrated in FIGS. 2A to 2E, 2H, and 2I of Example 1, and description thereof will not be repeated.

As illustrated in FIG. 3F, a mold 7 for forming a flow path was formed. First, an ODUR-1010 (trade name, produced by TOKYO OHKA KOGYO CO., LTD.) was applied by spin coating, and the applied material was dried. Then, a pattern exposure was performed with light having a wavelength of 230 to 350 nm and a light exposure amount of 15000 mJ/cm$^2$ using an exposure device (trade name: UX-3000 series, produced by USHIO INC.), and a development was performed, thereby forming a mold 7. The mold 7 had a thickness of 15 μm.

Thereafter, as illustrated in FIG. 3G, a resin layer 8 to be a flow path member 16 was formed. Specifically, a solution in which EHPE (trade name, produced by Daicel Corporation, epoxy resin) was dissolved in xylene was applied by spin coating, and the applied solution was dried, thereby forming a resin layer 8. The resin layer 8 had a thickness of 25 μm. Subsequently, the resin layer 8 was subjected to pattern exposure with light having a wavelength of 365 nm with a light exposure amount of 3000 J/m$^2$ using an exposure device (trade name: FPA-3000i5+, produced by Canon Inc.), thereby forming a pattern 9 of an ejection orifice. Then, a bake was performed at 90° C. for five minutes.

In the foregoing manner, a liquid discharge head was manufactured. From an observation of the liquid ejection head with an electron microscope, it was confirmed that the liquid ejection head was manufactured with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-111369, filed Jun. 1, 2015, which is hereby incorporated by reference herein in its entirety.

What is claimed is:

1. A method for manufacturing a liquid ejection head, the method comprising:

preparing a substrate including an energy-generating element disposed on a first surface of the substrate and a supply path for liquid;

disposing a dry film on the first surface of the substrate in such a manner that the dry film partially enters the supply path, the dry film having a first surface that faces the first surface of the substrate and a second surface that is opposite to the first surface of the dry film;

etching the dry film from the second surface of the dry film so that the dry film has an etched surface substantially in parallel with the first surface of the substrate and covers the supply path;

forming a resin layer to be a flow path member on the dry film covering the supply path; and removing the dry film covering the supply path.

2. The method according to claim 1, wherein the dry film remaining on the first surface of the substrate is used as a part of the flow path member.

3. The method according to claim 1, wherein the etching performed on the dry film is dry etching.

4. The method according to claim 1, wherein the dry film contains a non-photosensitive resin.

5. The method according to claim 4, wherein the non-photosensitive resin contained in the dry film has a softening point higher than a temperature at which the forming of the resin layer is performed.

6. The method according to claim 4, wherein:

the forming of the resin layer includes applying a solution in which a material constituting the resin layer is dissolved in a solvent and drying the solution; and a solubility of the non-photosensitive resin contained in the dry film in the solvent is lower than a solubility of a material constituting the resin layer in the solvent.

7. The method according to claim 1, wherein:

the dry film contains a photosensitive resin; and the method further comprises exposing the dry film to light to cure the dry film after the disposing of the dry film on the first surface of the substrate.

8. The method according to claim 1, wherein the removing of the dry film covering the supply path is performed by dry etching the dry film covering the supply path.

9. The method according to claim 1, wherein the forming of the resin layer includes forming a mold for forming a liquid flow path in such a manner that the mold partially enters the supply path.

10. The method according to claim 1, wherein in the disposing of the dry film, a length of the dry film entering the supply path from the first surface of the substrate is 5 μm to 100 μm.

11. The method according to claim 1, wherein in the disposing of the dry film, a length of the dry film entering the supply path from the first surface of the substrate is 6 μm to 50 μm.

12. The method according to claim 1, wherein after the etching of the dry film from the second surface of the dry film, a distance from the dry film covering the supply path to the first surface of the substrate is 1 μm to 30 μm.

13. The method according to claim 1, wherein after the etching of the dry film from the second surface of the dry film, a distance from the dry film covering the supply path to the first surface of the substrate is 2 μm to 10 μm.

14. The method according to claim 1, wherein the second surface of the dry film faces a mask layer.

15. The method according to claim 14, wherein the resin layer is formed on the dry film masked with the mask layer.

* * * * *